US011060396B2

(12) United States Patent
Androvandi et al.

(10) Patent No.: US 11,060,396 B2
(45) Date of Patent: Jul. 13, 2021

(54) METHOD FOR ESTIMATING A TRANSIT TIME OF AN ELEMENT CIRCULATING IN A BOREHOLE

(71) Applicant: Geoservices Equipements, Roissy en France (FR)

(72) Inventors: Sophie Androvandi, Roissy-en-France (FR); Maurice Ringer, Roissy-en-France (FR)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 849 days.

(21) Appl. No.: 15/725,745

(22) Filed: Oct. 5, 2017

(65) Prior Publication Data

US 2018/0112522 A1 Apr. 26, 2018

(30) Foreign Application Priority Data

Oct. 20, 2016 (EP) ..... 16290201

(51) Int. Cl.

| | |
|---|---|
| ***E21B 47/10*** | (2012.01) |
| ***E21B 21/08*** | (2006.01) |
| ***E21B 45/00*** | (2006.01) |
| ***E21B 47/09*** | (2012.01) |

(52) U.S. Cl.

CPC ..... *E21B 47/10* (2013.01); *E21B 21/08* (2013.01); *E21B 45/00* (2013.01); *E21B 47/09* (2013.01)

(58) Field of Classification Search

CPC ..... E21B 47/10; E21B 45/00; E21B 47/09

See application file for complete search history.

(56) References Cited

U.S. PATENT DOCUMENTS

| | | | | |
|---|---|---|---|---|
| 3,982,432 A * | 9/1976 | Hammond | ..... | E21B 21/08 73/152.45 |
| 4,807,469 A | 2/1989 | Hall | | |
| 7,347,260 B2 | 3/2008 | Ferguson et al. | | |

(Continued)

FOREIGN PATENT DOCUMENTS

WO WO2015030755 A1 3/2015

OTHER PUBLICATIONS

Search report R62 EPC issued in European Patent Application 16290201.9 dated May 17, 2017. 5 pages.

*Primary Examiner* — Janet L Suglo

(57) ABSTRACT

The disclosure relates to a method for estimating a transit time of an element circulating in a borehole during the drilling of the borehole. The transit time is representative of a time period for the element to move from the bottom of the borehole to its exit at the surface. The method comprises measuring a plurality of drilling parameters, computing a first signal of a first indicator based on a first set of measured drilling parameters and a second signal of a second indicator based on a second set of measured drilling parameters versus time. The first indicator is representative of a first type of events happening at the bottom of the borehole and the second indicator is representative of a second type of events happening at the exit of the borehole linked to the first type of events. The method also comprises characterizing a correlation between the first and second signals and determining a shift between the first and second signals. An estimated transit time is then determined from the shift.

14 Claims, 7 Drawing Sheets

(56) References Cited

U.S. PATENT DOCUMENTS

| | | | | |
|---|---|---|---|---|
| 8,172,007 | B2 | 5/2012 | Dolman et al. | |
| 8,775,086 | B2 | 7/2014 | Frunza | |
| 2009/0151939 | A1 | 6/2009 | Bailey et al. | |
| 2012/0253677 | A1 | 10/2012 | Frunza | |
| 2013/0048380 | A1* | 2/2013 | Rasmus | E21B 47/00 175/40 |
| 2016/0160640 | A1 | 6/2016 | Graves et al. | |

* cited by examiner

METHOD FOR ESTIMATING A TRANSIT TIME OF AN ELEMENT CIRCULATING IN A BOREHOLE

CROSS-REFERENCE TO RELATED APPLICATION

This application claims priority to and the benefit of European Patent Application No. 16290201.9, filed on Oct. 20, 2016, the entirety of which is incorporated herein by reference.

BACKGROUND

The invention relates generally to determining a transit time of the drilling fluid in a borehole.

It is well-known to calculate a theoretical transit time of the drilling fluid (or lag time) based on the estimated annular volume of the annulus at bit depth based on the geometry of the borehole and on the flow rate of a pump for injection of the drilling fluid in the borehole. This theoretical transit time is obtained by dividing the volume of the annulus by the pump flow rate.

However, this theoretical transit time is based on an estimated geometry of the borehole and does not take into account unexpected phenomena that may happen when drilling the borehole such as the apparition of cavings, that may locally enlarge the borehole.

Some publications such as U.S. Pat. No. 7,347,260 also disclose injecting markers in the drilling fluid and monitoring the markers at the exit of the borehole in order to determine the time spent by the drilling fluid in the borehole.

SUMMARY

The disclosure relates to a method for estimating a transit time of an element circulating in the borehole, such as drilling fluid or gas or cuttings carried by the drilling fluid.

In one embodiment, the disclosure relates to a method for estimating a transit time of an element circulating in a borehole during the drilling of the borehole. The transit time is representative of a time period for the element to move from the bottom of the borehole to its exit at the surface. The method comprises measuring a plurality of drilling parameters, computing a first signal of a first indicator based on a first set of measured drilling parameters and a second signal of a second indicator based on a second set of measured drilling parameters versus time. The first indicator is representative of a first type of events happening at the bottom of the borehole and the second indicator is representative of a second type of events happening at the exit of the borehole linked to the first type of events. The method also comprises characterizing a correlation between the first and second signals and determining a shift between the first and second signals. An estimated transit time is then determined from the shift.

The method uses events occurring naturally during drilling to compute the transit time. This transit time is computed automatically during the drilling of the borehole, depending on one or more drilling events.

In another embodiment, the disclosure relates to a system for estimating a transit time of an element circulating in a borehole during the drilling of the borehole. The transit time is representative of a time period for the element to move from the bottom of the borehole to its exit at the surface. The system comprises a measurement system for measuring a plurality of drilling parameters, and processors. The processors are configured to compute a first signal of a first indicator based on a first set of measured drilling parameters and a second signal of a second indicator based on a second set of measured drilling parameters versus time. The first indicator is representative of a first type of events happening at the bottom of the borehole and the second indicator is representative of a second type of events happening at the exit of the borehole linked to the first type of events. The processors are configured to characterize a correlation between the first and second signals and determine a shift between the first and second signals. An estimated transit time is then determined from the shift by the processors.

In a further embodiment, the disclosure relates to a computer program for estimating a transit time of an element circulating in a borehole during the drilling of the borehole. The transit time is representative of a time period for the element to move from the bottom of the borehole to its exit at the surface. The comprise machine-readable instructions to compute a first signal of a first indicator based on a first set of measured drilling parameters and a second signal of a second indicator based on a second set of measured drilling parameters versus time. The first indicator is representative of a first type of events happening at the bottom of the borehole and the second indicator is representative of a second type of events happening at the exit of the borehole linked to the first type of events. The machine-readable instructions also instruct to characterize a correlation between the first and second signals and determine a shift between the first and second signals. An estimated transit time is then determined from the shift.

BRIEF DESCRIPTION OF THE DRAWINGS

Various aspects of this disclosure may be better understood upon reading the following detailed description and upon reference to the drawings in which.

DETAILED DESCRIPTION

One or more specific embodiments of the present disclosure will be described below. These described embodiments are examples of the presently disclosed techniques. Additionally, in an effort to provide a concise description of these embodiments, some features of an actual implementation may not be described in the specification. It should be appreciated that in the development of any such actual implementation, as in any engineering or design project, numerous implementation-specific decisions may be made to achieve the developers' specific goals, such as compliance with system-related and business-related constraints, which may vary from one implementation to another. Moreover, it should be appreciated that such a development effort might be complex and time consuming, but would still be a routine undertaking of design, fabrication, and manufacture for those of ordinary skill having the benefit of this disclosure.

When introducing elements of various embodiments of the present disclosure, the articles "a," "an," and "the" are intended to mean that there are one or more of the elements. The terms "comprising," "including," and "having" are intended to be inclusive and mean that there may be additional elements other than the listed elements. Additionally, it should be understood that references to "one embodiment" or "an embodiment" of the present disclosure are not intended to be interpreted as excluding the existence of additional embodiments that also incorporate the recited features.

The disclosure relates to a method for estimating a transit time of an element, such as a drilling fluid, or gas or cuttings carried by the drilling fluid, circulating in the borehole during the drilling of the borehole.

Figure 1:
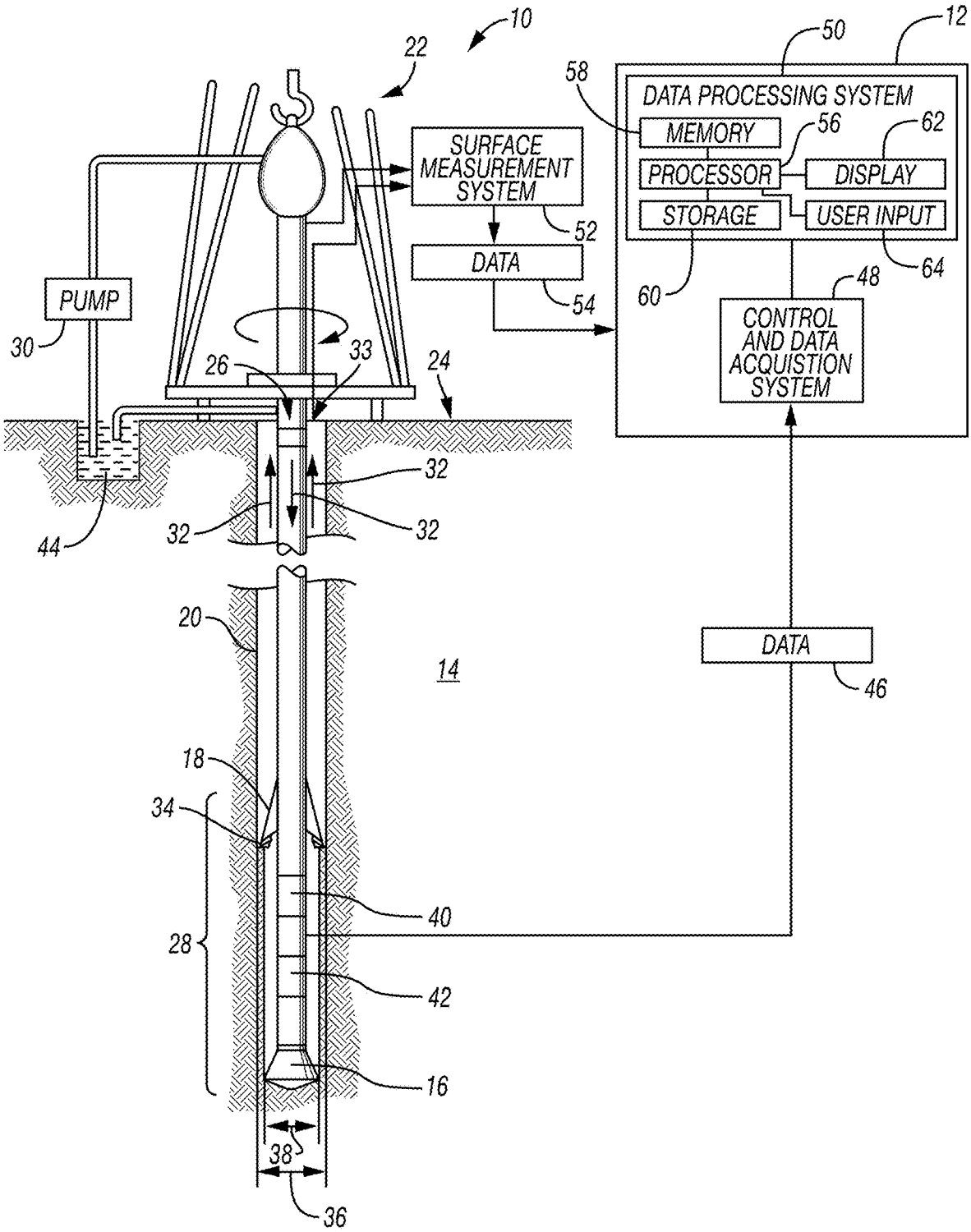
FIG. 1 is a schematic diagram of a drilling rig comprising a system for estimating a transit time of an element circulating in the borehole according to an embodiment of the disclosure.

With the foregoing in mind, FIG. 1 illustrates a drilling system 10 that includes a system 12 for estimating a transit time of an element circulating in a borehole 20 drilled into a geological formation 14 with a drill bit 16. In some cases, an underreamer 18 may also be used for drilling the formation but even if the underreamer is represented on the drawings it is optional in the drilling system. In the drilling system 10, a drilling rig 22 at surface 24 may rotate a drill string 26 having a bottom-hole assembly (BHA) 28 at its lower end.

As illustrated in FIG. 1, the BHA 28 includes the drill bit 16 and the underreamer 18. The drill bit 16 is located on the downhole end of the BHA and configured to drill or cut the geological formation about the bottom of the borehole 20. The underreamer 18 is disposed above (e.g., away from the downhole end of the BHA) the drill bit 16.

As the BHA 28 is rotated, a drilling fluid pump 30 is used to inject drilling fluid 32 into the borehole, which may be referred to as "mud" or "drilling mud," downward through the center of the drill string 26 in the direction of the arrow to the drill bit 16. The drilling fluid 32, which is used to cool and lubricate the drill bit 16, exits the drill string 26 through the drill bit 16. The drilling fluid 32 then carries drill cuttings away from the bottom of the wellbore 20 as it flows back to the surface 24, as shown by the arrows through an annulus 33 between the drill string 26 and the formation 14. In addition, as the drilling fluid 23 flows through the annulus 33 between the drill string 26 and the formation 14, the drilling fluid 32 may begin to invade and mix with fluid stored in the formation, which may be referred to as formation fluid (e.g., natural gas, or oil, or a combination thereof) and carries formation fluid to the surface. At the surface 24, return drilling fluid 32 exits the borehole 20 and is filtered and conveyed back to a mud pit 44 for reuse.

The BHA 28 may also include one or more downhole tools. The downhole tools may collect a variety of information relating to the geological formation 14 and/or the state of drilling of the well. For instance, a measurement-while-drilling (MWD) tool 40 may measure certain drilling parameters, such as the temperature, pressure, orientation of the drilling units (e.g., the drill bit 16 and the underreamer 18), angular speed of the drilling units, weight applied to the drilling units, torque generated by the drilling units, distance drilled per unit angular rotation (the depth-of-cut), rate of penetration, and so forth. Likewise, a logging-while-drilling (LWD) tool 42 may measure the physical properties of the geological formation 14, such as density, porosity, resistivity, lithology, and so forth.

The MWD tool 40 and/or the LWD tool 42 may collect a variety of data 46 that may be stored and processed in the BHA 28 or, as illustrated in FIG. 1, may be sent to the surface 24 for processing. The data 46 may be sent via a control and data acquisition system 48 to a data processing system 50 of the control system 12. The control and data acquisition system 48 may receive the data 46 in any suitable way. In one example, the control and data acquisition system 48 may transfer the data 46 via electrical signals pulsed through the geological formation 14 or via mud pulse telemetry using the drilling fluid 32. In another example, the data 46 may be retrieved directly from the MWD tool 40 and/or the LWD tool 42 upon return to the surface 24.

The drilling assembly also comprises a surface measurement system 52. The surface measurement system 52 may include any suitable device to measure physical and/or chemical properties, relative to the drilling fluid, such as the density, flow rate and/or the temperature of the drilling fluid entering or exiting the wellbore. The surface measurement system 52 may also be directly coupled to an above-the-surface portion of the drilling rig 22 to measure certain drilling parameters, such as the temperature, pressure, orientation of the drilling units (e.g., the drill bit 16 and the underreamer 18), weight applied to the drilling units, torque generated by the drilling units, rotation velocity of the drilling units, distance drilled per unit angular rotation (the depth-of-cut), flow rates of drilling fluid pumps, hook height, standpipe pressure and so forth. Furthermore, the surface measurement system 52 may comprise equipments for measuring a content of gas carried by the drilling fluid or a volume of the cuttings. Data 54 collected by the surface measurement system 52 may be processed in the surface measurement system 52 and sent via the control and data acquisition system 48 to the data processing system 50, or may be sent via the control and data acquisition system 48 to the data processing system 50 directly. Likewise, the control and data acquisition system 48 may receive the data 54 in any suitable way.

The data processing system 50 may include a processor 56, memory 58, storage 60, a display 62, and/or a user input 64. The data processing system 50 may use the data 46, 54 to estimate the transit time of an element circulating in the borehole. More specifically, as will be discussed in greater detail below, the data processing system 50 may estimate a transit time of an element circulating in the borehole. To process the data 46, 54, the processor 56 may execute instructions stored in the memory 58 and/or storage 60. As such, the memory 58 and/or the storage 60 of the data processing system 50 may be any suitable article of manufacture that can store the instructions. The memory 46 and/or the storage 60 may be ROM memory, random-access memory (RAM), flash memory, an optical storage medium, or a hard disk drive, to name a few examples. The display 62 may be any suitable electronic display that can display logs and/or other information relative to monitoring the stability of a wellbore. The user input 64 may be any suitable device that can be used by a user to input instructions, parameters, boundary conditions, or the like for performing the method according to the disclosure. The user input 64 may include a mouse, a keyboard, a touchpad, a touch screen, a voice recognition system, or the like.

Figure 2:
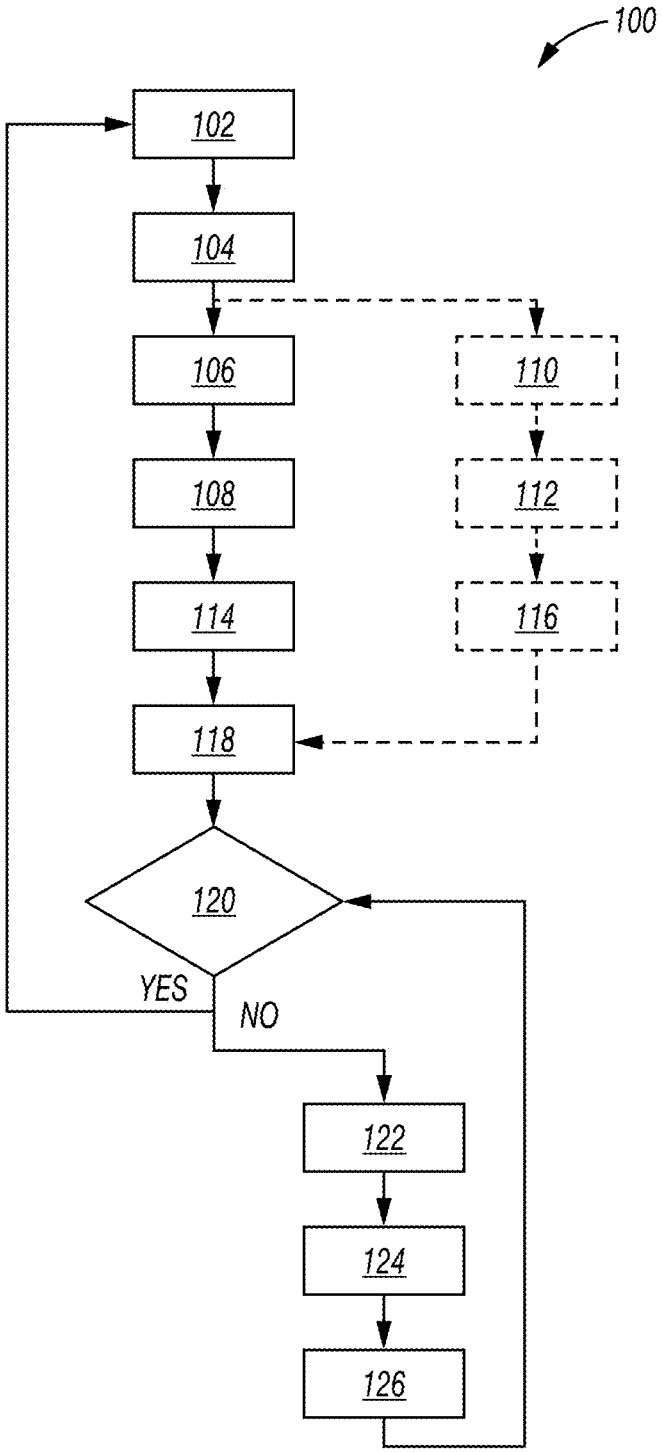
FIG. 2 is a block diagram of a method according to an embodiment of the disclosure.

The method 100 according to an embodiment of the disclosure will now be described in reference to FIG. 2. This method is performed during drilling of the borehole and circulation of the drilling fluid in the borehole.

In a first operation of the method, a plurality of drilling parameters are measured (block 102). These parameters may be measured by the downhole tools 40, 42 and/or by the surface measurement system 52 in real-time and continuously during the drilling of the borehole. The method may be carried out only with data 54 obtained from measurements taken by the surface measurement system 52 but some data 46 may also come from the downhole tools 40, 42 in some embodiments.

A theoretical transit time of an element circulating in the wellbore, here, the drilling fluid is then calculated (block 104) using the annular volume of the borehole and the pump flow rate, as explained in the background section. This theoretical transit time is also stored in the data processing system. When calculating the theoretical transit time, it is considered that the cuttings and gas circulating with the drilling fluid have the same theoretical transit time as the drilling fluid, which is not always the truth.

Based on the data 54 and potentially 46 obtained from the measurement systems, first and second signals representative of a first and second indicators versus time are computed (respectively at block 106 and 108). The first indicator is representative of a first type of events happening at the bottom of the borehole while the second indicator is representative of a second type of events happening at the exit of the borehole and linked to the first type of events. In other words, when the first type of events happens at the bottom of the borehole, the second type of events happens afterwards at the exit of the wellbore. In an embodiment, the first type of events may be a sweep (mud having properties for cleaning the borehole and in particular a greater density and viscosity than mud used otherwise during drilling) passing at the bottom of the borehole and the second type of event being the sweep passing at the exit of the wellbore. In another embodiment, the first type of events may be a particular pattern of gas or cuttings generated at the bottom of the borehole and the second type of events may be the particular pattern of gas or the cuttings passing at the exit of the borehole.

The first indicator may be based on first drilling parameters while the second indicator is based on second drilling parameters. For instance, when monitoring a sweep, the first indicator is standpipe pressure or friction (standpipe pressure divided by the square of pump flow), which shows that a sweep is passing at the bottom of the borehole by increasing while the second indicator is the mud weight out, which shows that a sweep is passing at the exit of the borehole by increasing. In another embodiment, when monitoring the gas, the first indicator may be the flow of pump, while the second indicator may be the total gas measured at the exit of the borehole. Indeed, when the pump are off, the total gas may increase if the static pressure in the borehole is close or less than the pressure of the formation, because the gas of the formation is not maintained in the formation anymore by the flow of drilling fluid. Therefore, a drop in the pump flow may correspond to an increase of gas at the bottom of the borehole. When monitoring gas or cuttings the first indicator may be also the rate of penetration (ROP) and the second indicator may be a volume of cuttings or content of total gas. Indeed, when the ROP increases, more cuttings are generated at the bottom of the borehole and more gas is extracted from the formation.

Several type of events may be monitored in parallel or in sequence and a third and fourth indicator for detecting a third type of events (happening at the bottom of the borehole) and a fourth type of events (linked to the third type of events and happening at the exit of the borehole) may be computed as well (respectively at optional blocks 110, 112). The type of events monitored by the system is not limited and the number of indicators computed is not either limited. As the events do not happen during the whole drilling of the borehole, as many events as possible may be monitored so as to get the more accurate estimation of the transit time The method then comprises characterizing a correlation between a first and second signals (at block 114 and at optional block 116) and to determine a shift between both signals. This is done by using a mathematical model. The use of the mathematical model allows an analysis of the signal that does not necessitate any human intervention and may enable to estimate the shift automatically. It may also be done in real-time. This operation is a complex operation as the first and second indicators enable detection of the first and second type of events but may also give 'false alarms', for instance the content of gas at the exit of the wellbore may increase only because the drill bit drills across a layer that is richer in formation gas even though there is no increase in ROP or the pumps are working. On the contrary, even though the mud may be off, if the static pressure remains high, there will be no increase in the content of gas at the exit of the wellbore.

The characterization of the correlation may be of many types: it may identify particular pattern of the signals (such as peaks) and determine the shift by associating the peaks of the first signal with peaks of the second signals. It may also use the entire signal to determine the shift by finding similarities between both signals. The mathematical models employed to characterize the correlation and determine the shift will be described thereafter. Depending on the type of the signals, the mathematical models used may be different. For instance, the ones used at block 114 and 116 may be different.

When the shift between the first and second signal is determined (and between third and fourth signals if applicable), the transit time is estimated (at block 118). It relies on the shift determination performed at block 114 (and potentially 116) and may correspond to the determined shift at block 114, or when several shifts are obtained for a predetermined time window, the transit time may be average or weighted average of both shifts.

At block 120, the estimated transit time is compared to the theoretical transit time obtained at block 104. Only one estimated transit time (ie an estimated transit time taken at a predetermined time) may be compared to the theoretical transit time (taken at the predetermined time). However, more likely, several estimated transit times are compared to the theoretical transit time. If both transit time are in line, ie if the difference between estimated transit time and theoretical transit time is in a predetermined range, the method is performed again for another time period. If the difference between estimated and theoretical transit time is not in the range, then an alarm may be sent to a user (at block 122). It may indeed indicate that the geometry of the borehole is not accurate and for instance that cavings have formed in the borehole. When several estimated transit times are compared to the theoretical transit time, the alarm may be sent only if a predetermined number of estimated transit times are out of the predetermined range.

When an alarm is sent, it means that a parameter relative to the borehole, and in particular relative to its geometry of the borehole has probably not been estimated or entered properly and may be corrected either by the user or automatically by the data processing system based on the estimated transit time (at block 124). When the parameter is corrected, a corrected theoretical transit time is calculated (at block 126) and the comparison between the corrected theoretical transit time and the estimated transit time is performed once more (at block 120). The theoretical transit time is then iteratively corrected until it corresponds to the estimated transit time. The model of the borehole is then also corrected accordingly in view of the model corresponding to the final corrected theoretical transit time.

The system and method disclosed above corresponds to a particular embodiment of the disclosure and variants may also be used. For instance, the calculation of the theoretical transit time is optional and the transit time may be determined only on the basis of the estimated transit time. Further, other indicators than the ones described hereinabove may be used. Other methods than the ones described below may also be used. The system may also comprise less or more measurement systems that what has been disclosed in this disclosure. Moreover, the processor may be located remotely from the well site or the processing system may comprise more than one processors located at the well site and/or remotely from the well site.

Examples of the methods and in particular of operations 106-114 of the methods will now be described in more details.

Sweep Detection:

In a first example, the first indicator is the friction and the second indicator is the mud weight at the exit of the borehole, used respectively, as explained above, to determine that a sweep is passing at the bottom of the borehole and at the exit of the borehole.

Figure 3:
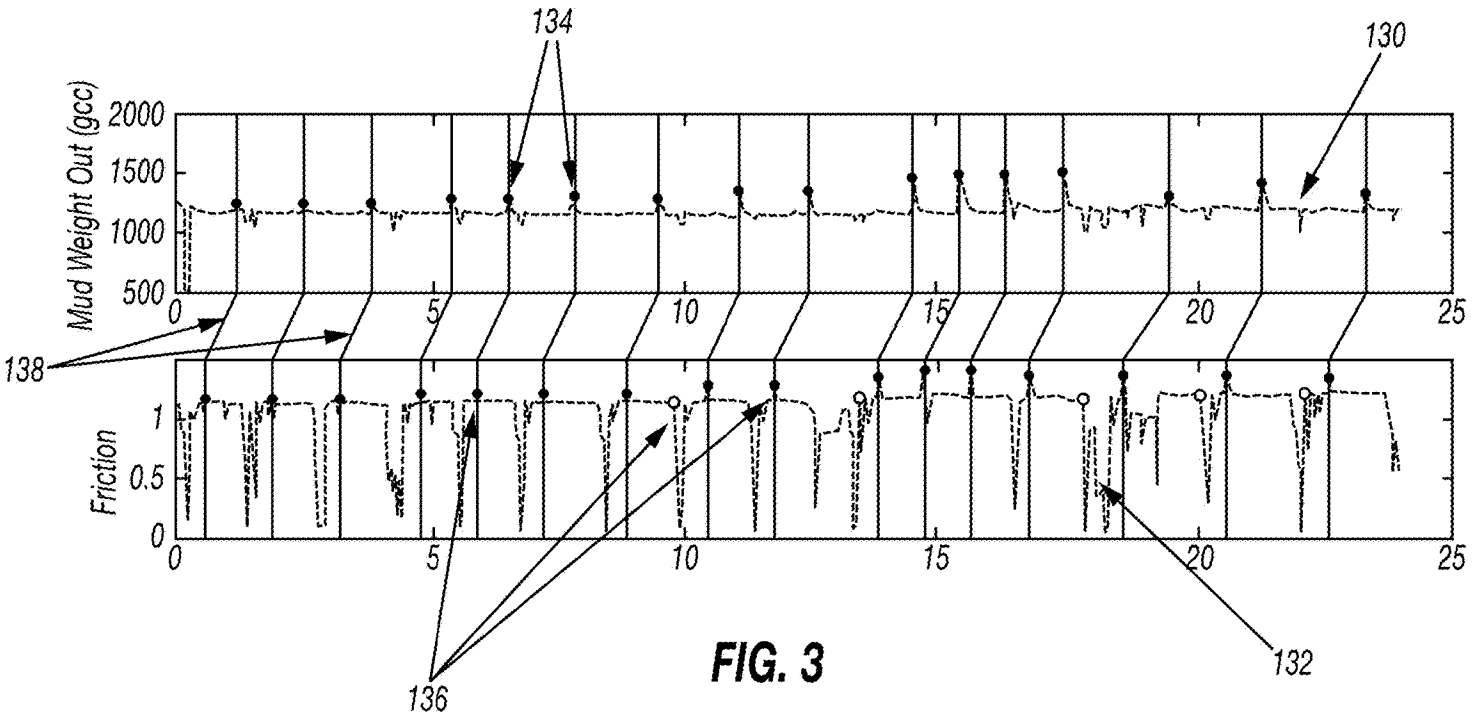
FIG. 3 is a plot of a first signal and second signal used in a first example of the method according to the disclosure.

In this example, the operation 114 comprises detecting the passing of the sweep at the bottom of the borehole by detecting a peak of the friction signal (positive mostly but sometimes when lighter mud is injected the peak may be negative) and detecting the passing of the sweep at the exit of the borehole by detecting a corresponding peak in the mud weight signal. As can be seen on FIG. 3, showing the mud weight signal (or second signal) 130 and the friction signal (or first signal) 132 versus time, the peaks are identified with circles 134, 136.

The identification of peaks comprises fitting signal extracts to a Gaussian curve and obtaining coefficients relative to the parameter of the peak as the Gaussian curve (such as height, width and curvature). Only elements that fit the Gaussian curve, optionally with certain parameters, are considered as "peaks". The other elements are considered as "signal artefacts".

When each of the peaks is characterized, the peaks of the first and second signals are compared in order to associate one peak of the first signal to a peak of the second signal when appropriate. As can be seen on the FIG. 3, some peaks detected on the first signal (friction signal) are not associated to any peak of the second (or mud weight) signal as these peaks are probably not due to a sweep.

This operation may be based on a probabilistic approach, testing the match of one peak of the second signal with each of the peaks of the first signals and then the match of the next peak in the second signal to each peak of the first signal and then choosing the solution having the best correlation. Some constraints may be input for the association operation such that a later peak of the first signal that appears after a predetermined peak of the first signal cannot be associated to an earlier peak of the second signal than the one to which the predetermined peak is associated. The theoretical transit time may be used as well in the estimation as peaks of the first signal distant from the theoretical transit time from a predetermined peak of the second signal may be tested first (for instance, two peaks cannot be associated if the transit time deriving from this association differs of more than 20% from the theoretical lag time). This correlation may be performed with any appropriate method, for instance with algorithms such as Dynamic Time Warping algorithms or simplex algorithms. On FIG. 3, the association of the peaks of the first and second signals is shown by the lines 138, each line linking a peak of the first signal and a peak of the second signal.

Figure 4:
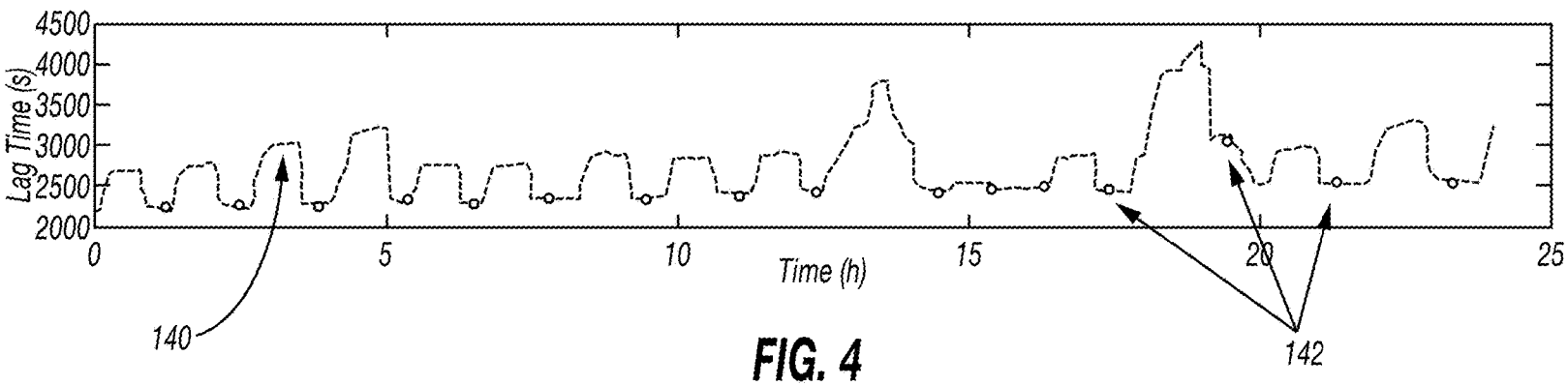
FIG. 4 is a plot of a theoretical transit time and of estimated transit times obtained according to the first example versus time.

FIG. 4 shows the theoretical transit time 140 shown in black line and the estimated transit times (associated only with certain predetermined time corresponding to times at which a sweep is injected in the borehole) which are represented by circles 142. In this example, estimated transit time and theoretical transit time are close to one another which shows that the method according to the disclosure enables to obtain good results. Further, it shows that, in this borehole, there is no discrepancy between the theoretical transit time and the estimated transit time. Estimated transit time enables to obtain punctual indication of the transit time in view of punctual events happening in the borehole and to verify periodically the theoretical transit time on this basis. It therefore does not necessitate injecting particular elements such as a marker in the borehole in order to obtain such estimation. The method also enables to obtain a direct estimation of the transit time to bottom of the borehole to the exit of the borehole while methods including injection of tracer only enable to obtain the direct estimation of the time spent in the borehole, ie from the injection of the drilling fluid in the borehole to the exit of the borehole.

Detection of Gas when the Pump Stops:

In this second example, the first indicator is the mud flow at the injection pump and the second indicator is the content of total gas at the exit of the borehole, used respectively, as explained above, to determine that an excess of gas is generated at the bottom of the borehole and that this excess of gas is passing at the exit of the borehole.

Figure 5:
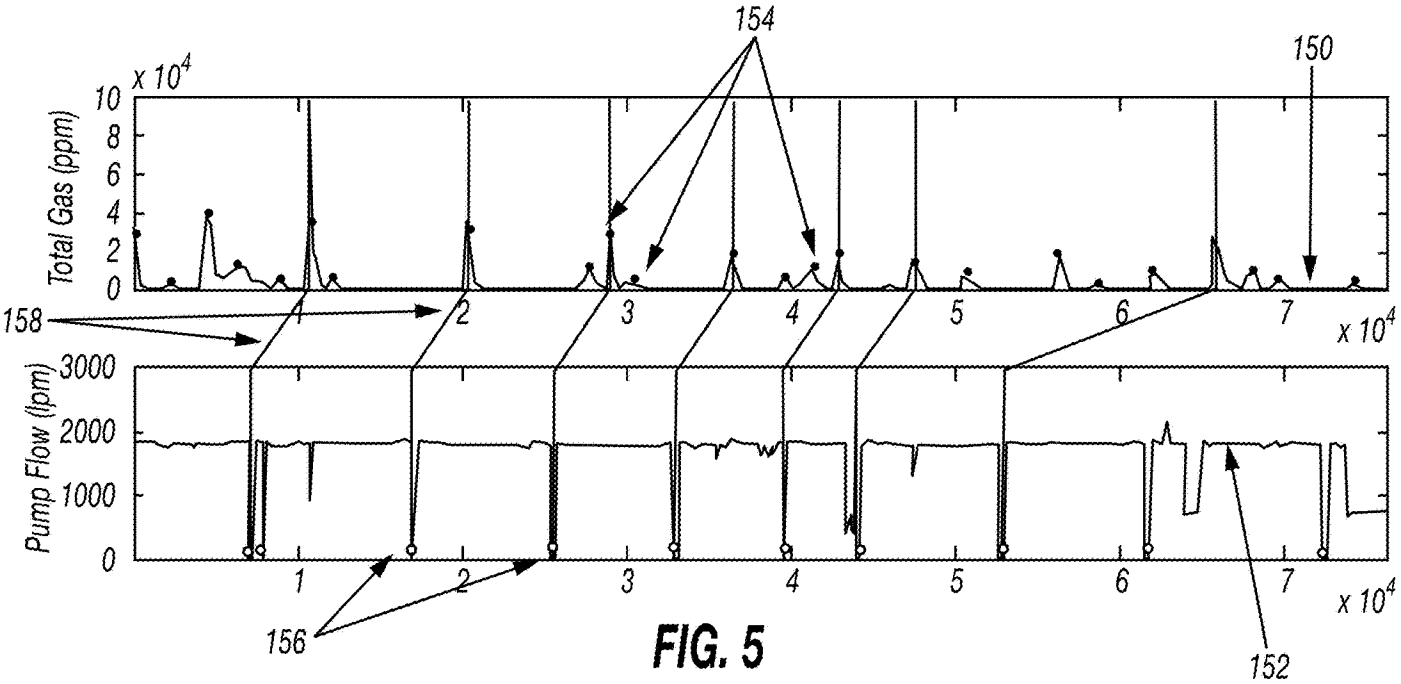
FIG. 5 is a plot of a first signal and second signal used in a second example of the method according to the disclosure.

In this example, the operation 114 comprises detecting the generation of the excess of gas at the bottom of the borehole by detecting a negative peak of the pump flow signal (drop of the pump flow to 0) and detecting the passing of the excess of gas at the exit of the borehole by detecting a positive peak in the total gas signal. As can be seen on FIG. 5, showing the total gas signal (or second signal) 152 and the pump flow signal (or first signal) 150 versus time, the peaks are identified with circles 154, 156.

As described in reference with the first example, the operation 114 comprises detecting and characterizing peaks of each of the signals and associating peaks of the first signal to peaks of the second signal based on the mathematical characterization, as explained in reference with the first example.

In this example, contrary to the first example, the peaks of the second signal are not always associated to the peaks of the first signal as the content of total gas may vary even though the pump are not off.

Figure 6:
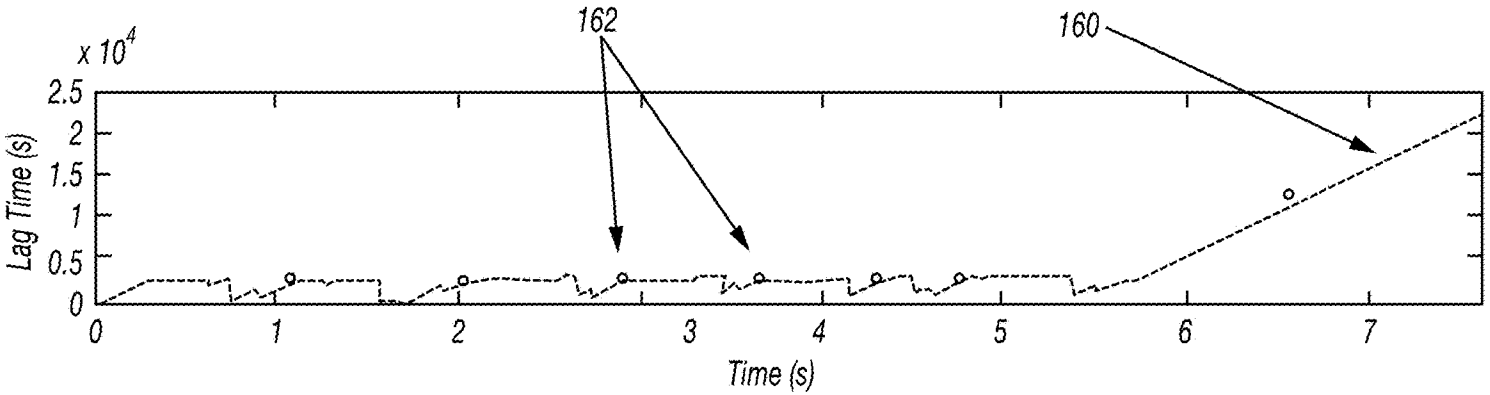
FIG. 6 is a plot of a theoretical transit time and of estimated transit times obtained according to the second example versus time.

In this example, we can see on FIG. 6 the theoretical transit time 160 (dotted line) and the punctual estimated transit times (circles) For this borehole, the estimated transit time corresponds approximately to the theoretical transit time but as seen on FIG. 6 each of the punctual estimated transit time is slightly greater than the theoretical transit time. As several estimated punctual transit times are greater than the theoretical transit time, it may indicate that the geometry of the borehole is not properly estimated and that correction of the theoretical transit time is required. The method may then enable to correct the theoretical transit time and to get a more accurate model of the geometry of the borehole by iteratively correcting the parameters enabling to obtain the theoretical transit time.

Total Gas and Period of Off-Bottom:

In this third example, the first indicator is a depth (bit depth (BD)—total depth of the borehole (TD)) and the second indicator is the content of total gas at the exit of the borehole, used respectively, to determine that less gas is generated at the bottom of the borehole, which appears when there is a period of off-bottom (ie when the drill bit is above total depth of the borehole and the first indicator is negative) and that this decrease of gas is passing at the exit of the borehole. In particular, when there is a period of off-bottom, the total gas content generally decrease and then increases again to reach the content generated before the off-bottom period.

The same method may be applied with a different second indicator, ie the volume of cuttings at the exit of the wellbore. It would enable to determine the cuttings transit time rather than the gas transit time.

In this example, the operation 114 comprises detecting the period of off-bottom, which correspond to the first indicator being negative and identifying the edges of each off-bottom period (first indicator=0) in the first signal.

It also comprises detecting the periods of decrease and increase of gas at the exit of the borehole in the second signal. This detection does not correspond to a peak as in the preceding example and is more difficult to detect. In this example, the detection of decrease and increase of gas comprises smoothing the second signal over a long window and looking for the intersections of the smoothed and non-smoothed second signals which correspond to the edges of the decreases and increase period.

Then, the method comprises discriminating edges corresponding to a decreasing total gas (beginning of period of interest for the second signal) from increasing total gas (end of period of interest). Similarly, it comprises discriminating the beginning and end of off-bottom periods. Such discrimination may be performed according to any appropriate method such as using a derivative of the signal over time.

Once the discrimination has been performed, edges corresponding to beginning of second period of interest for the second signal are associated with the ones corresponding to a beginning of off-bottom period (for the first signal). Similarly, the edges corresponding to an end of the period of interest in relationship with the second signal are associated with the ones corresponding to an end of off-bottom period, as already explained for the first and second examples.

Figure 7:
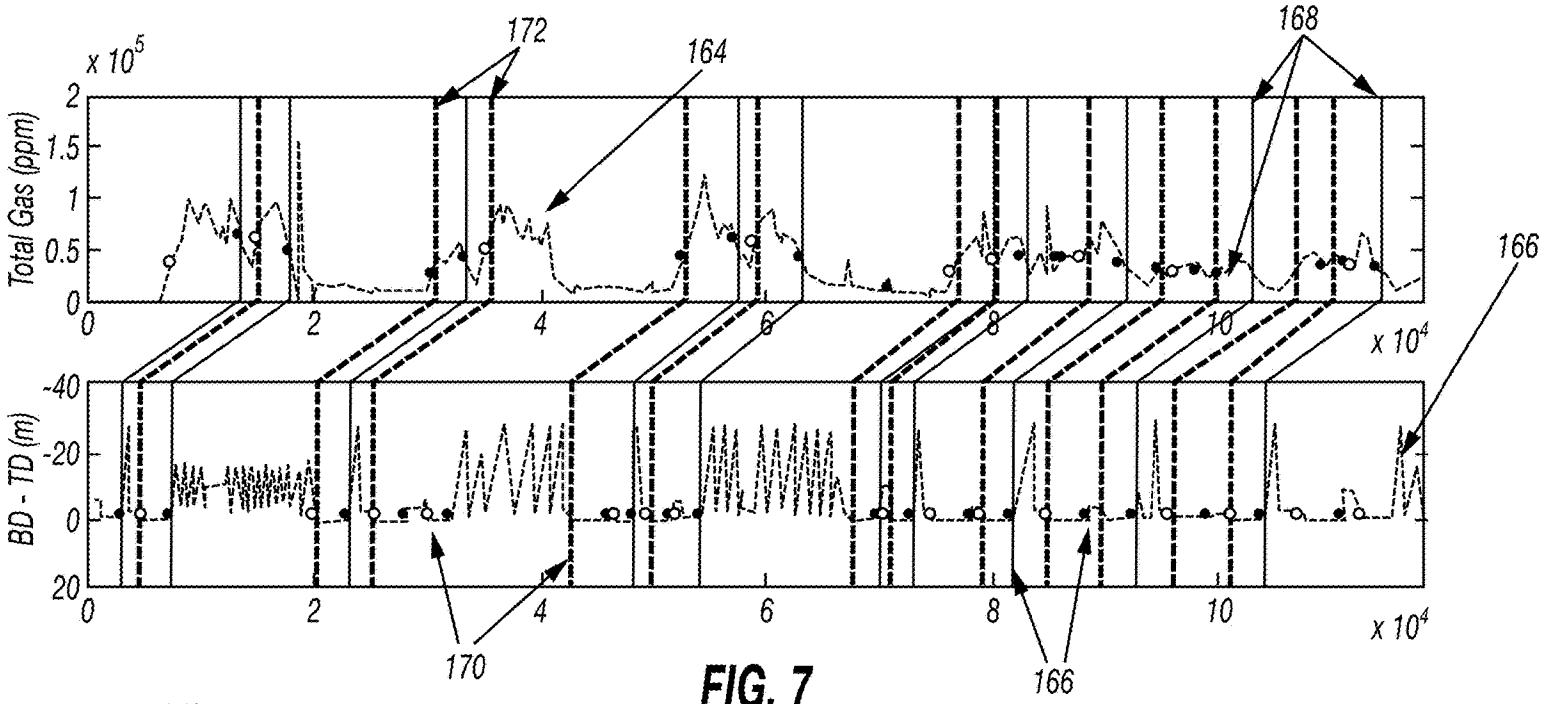
FIG. 7 is a plot of a first signal and second signal used in a third example of the method according to the disclosure.

FIG. 7 shows the total gas signal (or second signal) 164 and the depth signal (or first signal) 166 versus time, the edges are identified with points (if not associated with an edge of the other signal) or vertical lines (if associated with an edge of the other signal), the edges 166 corresponding to a beginning of an off-bottom period (first signal) and the edges 168 corresponding to the decrease of total gas (second signal) being represented by black circles or continuous lines, while the edges 170 corresponding to the end of an off-bottom period (first signal) and the edges 172 corresponding to an increase of total gas (second signal) are represented by white circles or dotted bold lines.

The association of the edges 166, 168 may be performed independently from the association of edges 170, 172 or both association may be performed simultaneously as there is a temporal dependence between them (two beginnings of periods cannot be identified if an end of period is not identified in between them).

As can be seen on FIG. 7, in this embodiment, neither all the detected edges of the first signal and the ones of the second signal are used for determining the estimated transit time. Indeed, the total gas content may decrease and increase for other reasons that the off-bottom period and the off-bottom period may not have an influence on the total gas content depending on their parameters such as their duration.

Figure 8:
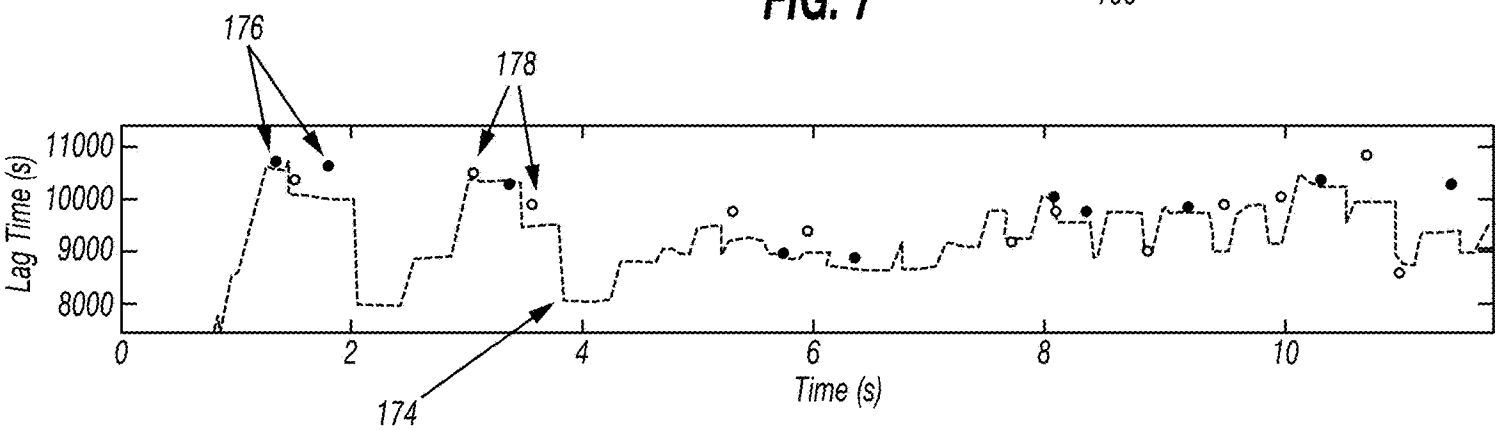
FIG. 8 is a plot of a theoretical transit time and of estimated transit times obtained according to the third example versus time.

FIG. 8 shows the theoretical transit time 174 and punctual estimated transit time 176, 178 detected respectively with beginning (in black) and end (in white) of off-bottom period.

Total Gas Versus ROP:

As explained above, there is a correlation between the rate of penetration and the content of total gas measured at the exit of the borehole. Indeed, as we start drilling, total gas should start to increase. At the opposite, when we stop drilling total gas should decrease.

Here, the first signal is therefore the ROP versus time, while the second signal is the total content of gas measured at the exit of the borehole. However, all the methods that are described below may also apply when replacing the total gas content as a second signal by the volume of cuttings measured at the exit of the borehole. It would enable to determine the cuttings transit time rather than the gas transit time.

These methods may also be applied to any appropriate indicators such as gamma-ray count at the bottom of the wellbore (obtained via a downhole tool as known in the art) as a first indicator and gamma-ray count taken on the cuttings at the exit of the wellbore.

Applying a Correlation Coefficient

In this embodiment, contrary to the preceding one, there is no particular event or singularity of the first or second signal that is looked for but the characterization of the correlation looks for similarities between the two signals in their entirety.

A first mathematical method that may be used to determine such correlation between first and second signals comprises applying a coefficient for estimating correlation between the first signal and a signal derived from the second signal on a certain time period. This coefficient is for instance the Pearson's coefficient, detailed below.

$$\mathrm{corr}(x, y) = \frac{1}{m}\sum_{i=0}^{m-1}\left(\frac{x_i - \mu_x}{\sigma_x}\right)\left(\frac{y_i - \mu_y}{\sigma_y}\right)$$

where x is the first signal and y the signal derived from the second signal $\mu_z$ is the mean and $\sigma_z$ is the standard deviation of the signal named z.

and the indicia i stands for a predetermined time and $x_i$ or $y_i$ are values of the signals x or y at the predetermined time i.

Other coefficient that enable to measure the correlation between two signals may also be used.

Each of the signal y derived from the second signal are the second signal on which a predetermined shift is applied. Several signal $y^{(k)}$ may be tested wherein $y^{(k)}=y^{(0)}-kT$ wherein $y^{(0)}$ corresponds to the second signal and T is a predetermined duration.

When applying the Pearson coefficient, it returns a number between −1 (perfect anticorrelation) and 1 (perfect correlation).

Figure 9:
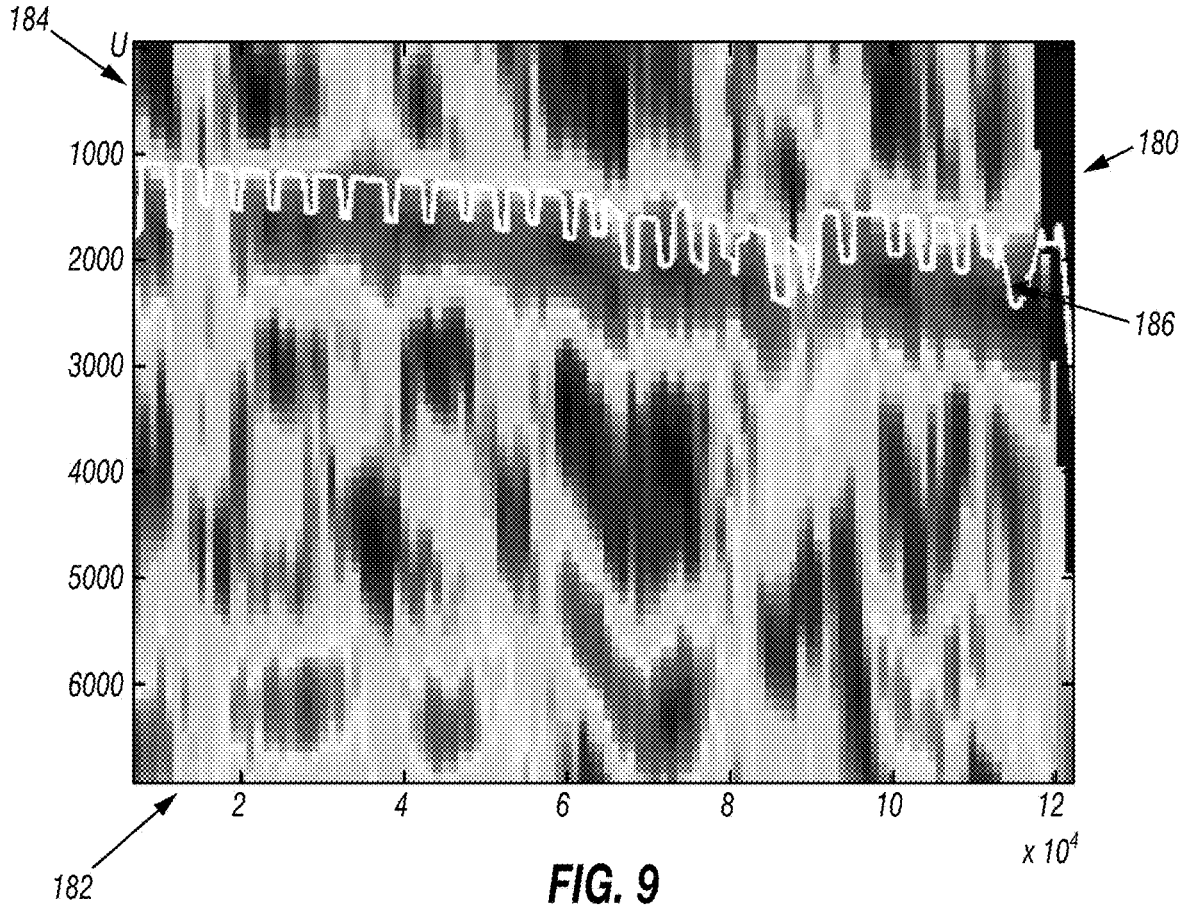
FIG. 9 shows a correlation matrix between first signal and signals derived from second signal obtained according to a fourth example of the method of the disclosure.

FIG. 9 shows the matrix 180 resulting of the use of the mathematical method in this embodiment, with the x-axis 182 representing time and y-axis 184 representing shift (kT) corresponding to a tested transit time. The light zones represent the zones in which the correlation is the highest while the dark zones are the zones in which correlation is the lowest.

From this correlation matrix, it is possible to compute a optimum shift versus time which will correspond to the estimated transit time. This optimum shift corresponds to the shift for which the correlation is the highest during a predetermined time period. On FIG. 9, the theoretical transit time 186 is also represented as a white line. This embodiment enables to estimate not only punctual transit times as the preceding embodiments but a continuous signal of transit time versus time.

Figure 10:
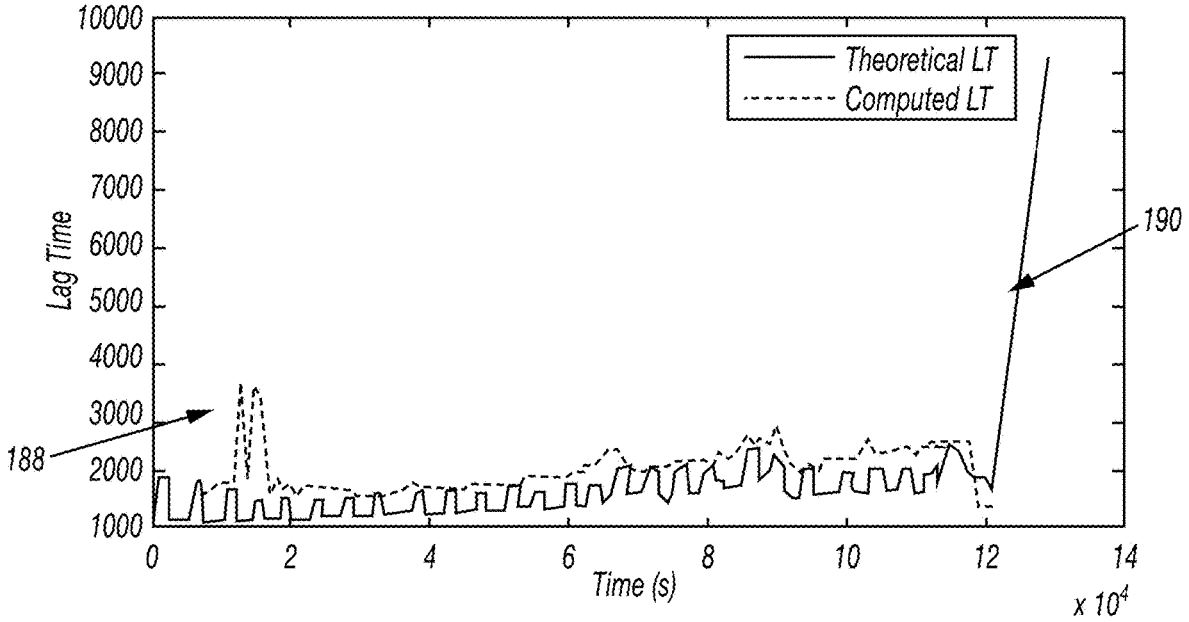
FIG. 10 is a plot of a theoretical transit time and of estimated transit time obtained according to the fourth example versus time.

FIG. 10 shows the comparison of the theoretical transit time 190 (continuous line) and the estimated transit time 188 (dotted line) that shows that the theoretical transit time may be underestimated and should be corrected.

Dynamic Time Warping:

In another embodiment, the use of the mathematical method may correspond to the use of a Dynamic Time Warping (DTW) algorithm. Such an algorithm compares the similarities between two signals and enables to build an error matrix representing the similarities between different parts of the first and second signal.

Figure 11:
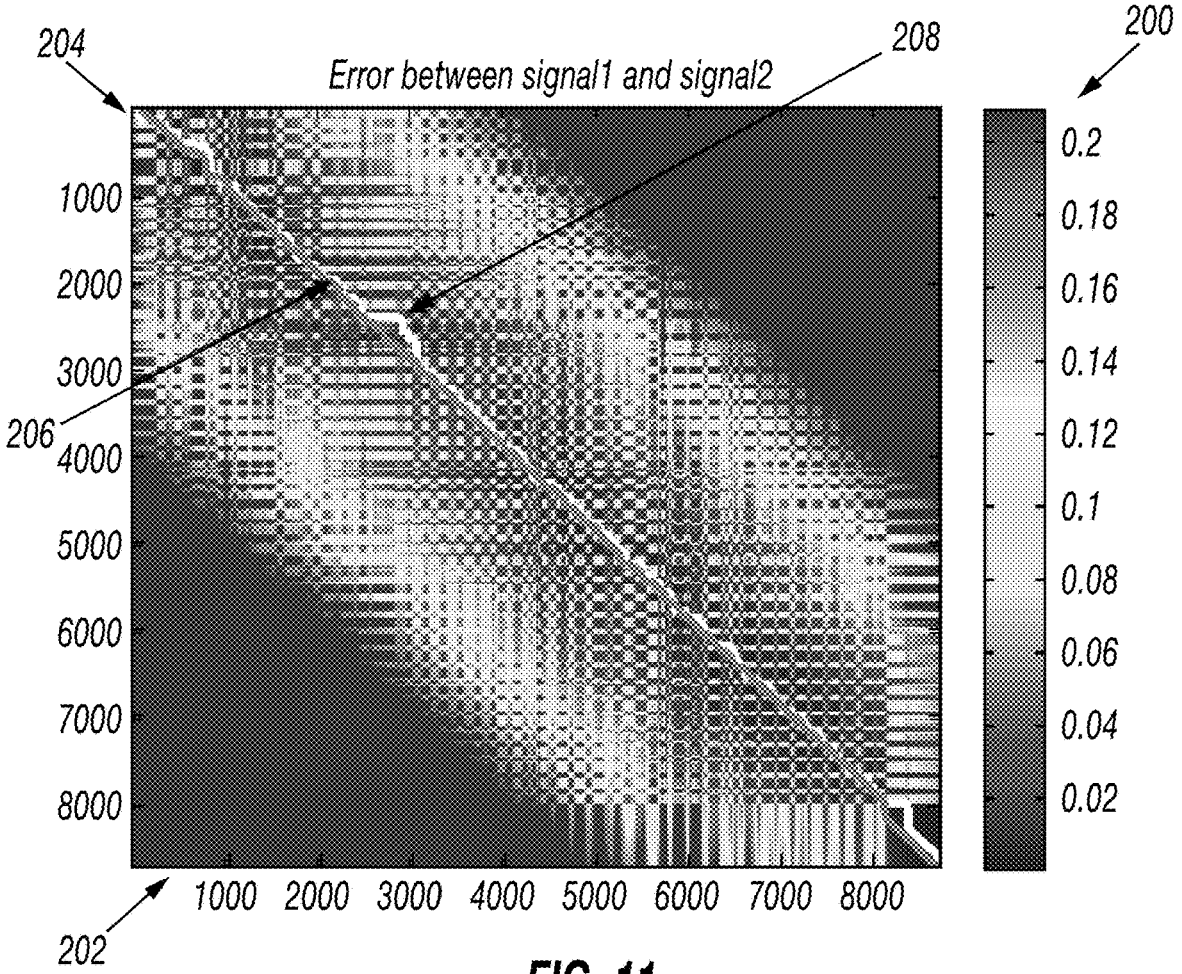
FIG. 11 is an error matrix obtained comparing a first and second signal shifted from the theoretical transit time obtained according to a fifth example of the method of the disclosure.

On FIG. 11, we can see an error matrix 200 pointing out similarities and discrepancies between the first signal 202 (represented on the x-axis) and the second signal 204 (represented on the y-axis) obtained thanks to the DTW algorithm. By choosing a path that minimizes the global error between both signals, it enables to estimate the transit time. On FIG. 9, the theoretical transit time 206 is shown in gray and the estimated transit time 208 is shown in white.

Figure 12:
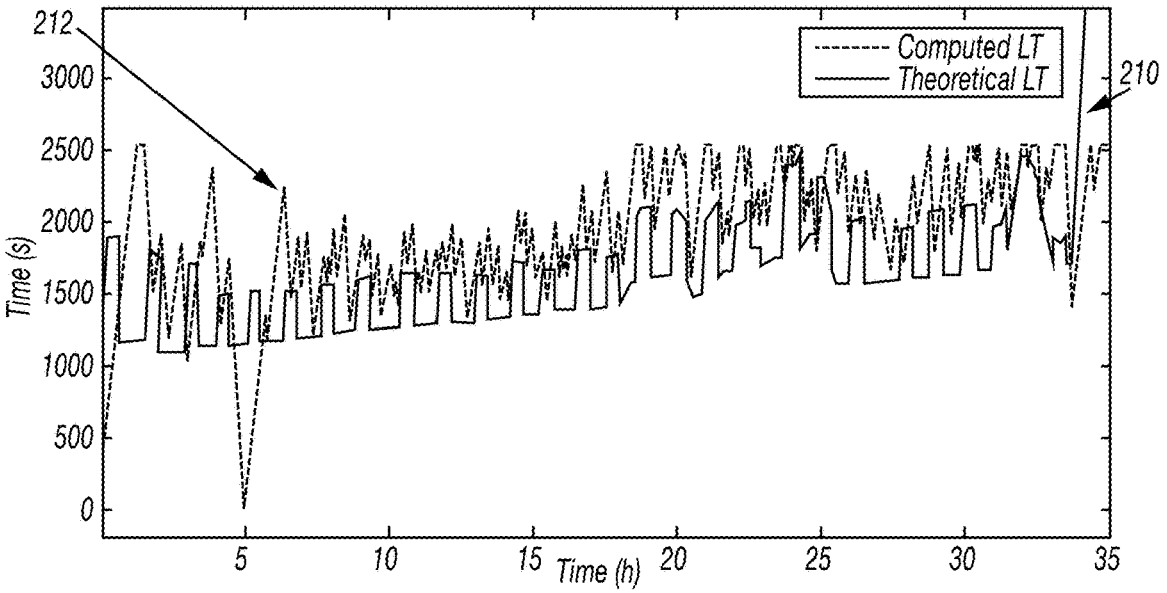
FIG. 12 is a plot of a theoretical transit time and of estimated transit time obtained according to the fifth example versus time

On FIG. 12 the theoretical 210 (continuous line) and estimated transit time (dotted line) are also shown more clearly. Once again, and even though the estimated transit time shows some irregularities at the beginning it is generally greater than the theoretical transit time 212 which shows that the theoretical transit time should probably be corrected as well as the model of the borehole.

The specific embodiments described above have been shown by way of example, and it should be understood that these embodiments may be susceptible to various modifications and alternative forms. It should be further understood that the claims are not intended to be limited to the particular forms disclosed, but rather to cover all modifications, equivalents, and alternatives falling within the spirit and scope of this disclosure.

The disclosure generally relates to a method for estimating a transit time automatically based on naturally-occurring events such that the determination of an accurate transit time does not necessitate any human intervention or any specific equipment or tool, other than the ones already installed on the rig.

The disclosure generally relates to a method for estimating a transit time of an element circulating in a borehole during the drilling of the borehole, wherein the transit time is representative of a time period for the element to move from the bottom of the borehole to the exit of the borehole situated at the surface, wherein the method comprises:

measuring a plurality of drilling parameters, computing a first signal of a first indicator versus time, wherein the first indicator is obtained based on a first set of measured drilling parameters, and wherein the first indicator is representative of a first type of events happening at the bottom of the borehole computing a second signal of a second indicator versus time, wherein the second indicator is obtained based on a second set of measured drilling parameters, and wherein the second indicator is representative of a second type of events happening at the exit of the borehole, wherein the second type of events is linked to the first type of events, characterizing a correlation between the first and second signals and determine at least a shift between the first and second signals, and determining at least estimated transit time from the shift.

The element may be one of a drilling fluid, cuttings carried by the drilling fluid, and gas carried by the drilling fluid. Several transit times may be determined in parallel for several elements circulating in the wellbore.

The method may be performed in real-time.

Characterizing the correlation may comprise:

detecting a plurality of first events of the first type based on the first signal, detecting a plurality of second events of the second type based on the second signal, associating at least a first event and a second event and determining the shift based on the association.

In this case, determining the estimated transit time may comprise determining at least one punctual estimated transit time associated with a predetermined time, corresponding in particular to the time of a first or an associated second event from which a shift was determined. Further, each of the first events may not be associated to a second event and/or each of the second events may not be associated to a first event.

Each of the first event may correspond to a peak of the first signal, and each of the second event may correspond to a peak of the second signal, wherein detecting the first and second events comprise comprises fitting extract of the signals to a particular mathematical function, wherein the peaks are the extracts of the signal corresponding to the function. The function may be a Gaussian function.

In a particular embodiment, characterizing the correlation may comprise identifying a period of activity associated to each of the first and second signal, wherein the first type of events and second type of events comprise respectively edges of the period of activity for the first and second signals. The method may then comprise discriminating beginning and end of period of activity and associating beginning, respectively end, of period of activity for the first signal with beginning, respectively end, of period of activity for the second signal.

In another embodiment, characterizing the correlation comprises calculating, during a predetermined time window, a correlation coefficient between the first signal and a plurality of signals derived from the second signal, wherein each of the second derived signals correspond to the second signal with a respective predetermined shift.

In another embodiment, characterizing the correlation comprises using a dynamic time warping algorithm during a predetermined time window for determining a shift between the first and second signal.

In the previous two embodiment, the determining the estimated transit time comprises a signal of estimated transit time versus time.

In an embodiment, the first indicator is a standpipe pressure or a friction, wherein the friction corresponds to the standpipe pressure divided by the square of the pump flow, and the second indicator is a mud weight at the exit of the wellbore.

In another embodiment, the first indicator is a flow rate of a pump injecting a drilling fluid in the borehole, a depth of the drill bit or a rate of penetration and the second indicator is a content of total gas at the exit of the wellbore or a volume of cuttings at the exit of the wellbore.

The method may also comprise:

computing a third signal of a third indicator versus time, wherein the third indicator is obtained based on a third set of measured drilling parameters, and wherein the third indicator is representative of a third type of events happening at the bottom of the borehole computing a fourth signal of a fourth indicator versus time, wherein the fourth indicator is obtained based on a fourth set of measured drilling parameters, and wherein the fourth indicator is representative of a fourth type of events happening at the exit of the borehole, wherein the fourth type of events is linked to the third type of events, characterizing a correlation between the third and fourth signals and determining a shift between the third and fourth signals, and computing the estimated transit time from the shift between first and second signals and from the shift between third and fourth signals.

The third indicator may be distinct from or similar to the first one while the fourth indicator may be distinct from or similar to the second one.

The method may also comprise:

computing a theoretical transit time based on a model of the borehole comprising parameters relative to the architecture of the borehole, when a difference between the theoretical transit time and the estimated transit time goes over a predetermined threshold, iteratively correcting at least one parameter of the model.

The theoretical transit time may be use during the correlation characterization in order to facilitate the characterization.

The disclosure also related to a system for estimating a transit time of an element circulating in a borehole during the drilling of the borehole, wherein the transit time is representative of a time period for the element to move from the bottom of the borehole to the exit of the borehole situated at the surface, wherein the system comprises:

at least a measurement system for measuring a plurality of drilling parameters, one or more processors for:

computing a first signal of a first indicator versus time, wherein the first indicator is obtained based on a first set measured drilling parameters, and wherein the first indicator is representative of a first type of events happening at the bottom of the borehole computing a second signal of a second indicator versus time, wherein the second indicator is obtained based on a second set of measured drilling parameters, and wherein the second indicator is representative of a second type of events happening at the exit of the borehole, wherein the second type of events is linked to the first type of events, characterizing a correlation between the first and second signals and determine at least a shift between the first and second signals, and determining at least an estimated transit time from the shift.

The disclosure also relates to a computer program for estimating a transit time of an element circulating in a borehole during the drilling of the borehole, wherein the transit time is representative of a time period for the element to move from the bottom of the borehole to the exit of the borehole situated at the surface, comprising machine-readable instructions for:

computing a first signal of a first indicator versus time, wherein the first indicator is obtained based on a first set of parameters measured relative to the borehole received by the computer program, and wherein the first indicator is representative of a first type of events happening at the bottom of the borehole computing a second signal of a second indicator versus time, wherein the second indicator is obtained based on a second set of measured drilling parameters received by the computer program, and wherein the second indicator is representative of a second type of events happening at the exit of the borehole, wherein the second type of events is linked to the first type of events, characterizing a correlation between the first and second signals and determining at least a shift between the first and second signals, and determining at least an estimated transit time from the shift.

The disclosure also relates to a method for estimating a transit time of a drilling fluid circulating in a borehole during the drilling of the borehole, wherein the transit time is representative of a time period for the drilling fluid to move from the bottom of the borehole to the exit of the borehole situated at the surface, wherein the method comprises:

measuring a plurality of drilling parameters, including standpipe pressure, flow rate of an injection pump and mud weight at the exit of the wellbore computing a first signal representative of a friction of the drilling fluid versus time, wherein the friction is obtained based on standpipe pressure and flow rate, computing a second signal representative of the mud weight versus time, characterizing a correlation between the first and second signals and determining at least a shift between the first and second signals, wherein characterizing the correlation comprises:

detecting at least a peak of the first signal, representative of a sweep passing at the bottom of the borehole detecting at least a peak of the second signal, representative of a sweep passing at the exit of the borehole associating at least a peak of the first signal and a peak of the second signal and determining the shift based on the association.

determining at least an estimated transit time from the shift.

The disclosure also relates to a method for estimating a transit time of gas carried by a drilling fluid circulating in a borehole during the drilling of the borehole, wherein the transit time is representative of a time period for the gas to move from the bottom of the borehole to the exit of the borehole situated at the surface, wherein the method comprises:

measuring a plurality of drilling parameters, including flow rate of the pump for injection the drilling fluid in the borehole and a content of total gas in the drilling fluid at the exit of the borehole computing a first signal representative of the flow rate versus time, computing a second signal representative of the total gas content versus time, characterizing a correlation between the first and second signals and determining at least a shift between the first and second signals, wherein characterizing the correlation comprises:

detecting at least a negative peak of the first signal, representative of a period during which the pump is off and an increase of formation gas may enter the drilling fluid at the bottom of the wellbore detecting at least a positive peak of the second signal, associating at least a peak of the first signal and a peak from the second signal and determining the shift based on the association.

determining at least an estimated transit time from the shift.

The disclosure also relates to a method for estimating a transit time of gas carried by a drilling fluid circulating in a borehole during the drilling of the borehole, wherein the transit time is representative of a time period for the gas to move from the bottom of the borehole to the exit of the borehole situated at the surface, wherein the method comprises:

measuring a plurality of drilling parameters, including a depth of a drill bit from drilling the borehole and a content of total gas in the drilling fluid at the exit of the borehole, computing a first signal of a difference between measured depth and total depth of the borehole versus time, computing a second signal of the total gas versus time, characterizing a correlation between the first and second signals and determine at least a shift between the first and second signals, including:

identifying edges of a first period of activity being an off-bottom period by identifying the intersection of the first signal with 0, smoothing the second signal over a long time window and identifying edges of second period of activity by identifying the intersection of second signal and smoothed second signal, discriminating beginning and end of each period of activity, associating at least a beginning of first period of activity with a beginning of second period of activity and at least an end of first period of activity with an end of second period of activity and determining shifts based on each association, determining at least an estimated transit time from the shifts.

The disclosure also relates to a method for estimating a transit time of cuttings carried by a drilling fluid circulating in a borehole during the drilling of the borehole, wherein the transit time is representative of a time period for the gas to move from the bottom of the borehole to the exit of the borehole situated at the surface, wherein the method comprises:

measuring a plurality of drilling parameters, including a depth of a drill bit from drilling the borehole and a volume of cuttings at the exit of the borehole, computing a first signal of a difference between measured depth and total depth of the borehole versus time, computing a second signal of the volume of cuttings versus time, characterizing a correlation between the first and second signals and determine at least a shift between the first and second signals, including:

identifying edges of a first period of activity being an off-bottom period by identifying the intersection of the first signal with 0, smoothing the second signal over a long time window and identifying edges of second period of activity by identifying the intersection of second signal and smoothed second signal, discriminating beginning and end of each period of activity, associating at least a beginning of first period of activity with a beginning of second period of activity and at least an end of first period of activity with an end of second period of activity and determining shifts based on each association, determining at least an estimated transit time from the shift.

The disclosure also relates to a method for estimating a transit time of gas carried by the drilling fluid circulating in a borehole during the drilling of the borehole, wherein the transit time is representative of a time period for the gas to move from the bottom of the borehole to the exit of the borehole situated at the surface, wherein the method comprises:

measuring a plurality of drilling parameters, including a rate of penetration and a content of total gas in the drilling fluid at the exit of the borehole computing a first signal representative of the rate of penetration versus time, computing a second signal representative of the total gas content versus time, calculating a correlation coefficient during at least a predetermined time window between the first signal and a plurality of signals derived from the second signal, wherein each of the derived signals correspond to the second signal with a respective predetermined shift, and selecting the shift that corresponds to the derived signal having the best correlation coefficient, determining at least an estimated transit time from the shift.

The disclosure also relates to a method for estimating a transit time of cuttings carried by the drilling fluid circulating in a borehole during the drilling of the borehole, wherein the transit time is representative of a time period for the cuttings to move from the bottom of the borehole to the exit of the borehole situated at the surface, wherein the method comprises:

measuring a plurality of drilling parameters, including a rate of penetration and a volume of cuttings at the exit of the borehole computing a first signal representative of the rate of penetration versus time, computing a second signal representative of the volume of cuttings versus time, calculating a correlation coefficient during at least a predetermined time window between the first signal and a plurality of signals derived from the second signal, wherein each of the derived signals correspond to the second signal with a respective predetermined shift, and selecting the shift that corresponds to the derived signal having the best correlation coefficient, determining at least an estimated transit time from the shift.

The disclosure also relates to a method for estimating a transit time of gas carried by the drilling fluid circulating in a borehole during the drilling of the borehole, wherein the transit time is representative of a time period for the gas to move from the bottom of the borehole to the exit of the borehole situated at the surface, wherein the method comprises:

measuring a plurality of drilling parameters, including rate of penetration and a content of total gas in the drilling fluid at the exit of the borehole computing a first signal representative of the rate of penetration versus time, computing a second signal representative of the total gas content versus time, using a dynamic time warping algorithm to characterize a correlation between the first and second signals and determine at least a shift between the first and second signals versus time based on the dynamic time warping, determining at least an estimated transit time from the shift.

The disclosure also relates to a method for estimating a transit time of cuttings carried by the drilling fluid circulating in a borehole during the drilling of the borehole, wherein the transit time is representative of a time period for the cuttings to move from the bottom of the borehole to the exit of the borehole situated at the surface, wherein the method comprises:

measuring a plurality of drilling parameters, including rate of penetration and a volume of cuttings at the exit of the borehole computing a first signal representative of the rate of penetration versus time, computing a second signal representative of the volume of cuttings versus time, using a dynamic time warping algorithm to characterize a correlation between the first and second signals and determine at least a shift between the first and second signals versus time based on the dynamic time warping, determining at least an estimated transit time from the shift.

The invention claimed is:

1. A method for estimating a transit time of an element circulating in a borehole during drilling of the borehole, wherein the transit time is representative of a time period for the element to move from the bottom of the borehole to the exit of the borehole at the surface, wherein the method comprises:

measuring a plurality of drilling parameters, computing a first signal of a first indicator versus time, wherein the first signal is a difference between a bit depth and a total depth of the borehole, wherein the difference is indicative of when a drill bit is off bottom in the borehole, computing a second signal of a second indicator versus time, wherein the second signal is a measure of a total gas content or a total cutting volume exiting the borehole at the surface, characterizing a correlation between the first and second signals, wherein characterizing the correlation includes (i) identifying edges in the first signal indicative of transitions of the bit from on the bottom to off the bottom or from off the bottom to on the bottom of the borehole and (ii) identifying increases and decreases in the second signal at the edges, processing the correlation to determine the transit time, wherein the transit time is indicative of the time period for the element comprising gas or cuttings to move from the bottom of the borehole to the surface.

2. A method for estimating a transit time of an element circulating in a borehole during drilling of the borehole, wherein the transit time is representative of a time period for the element to move from the bottom of the borehole to the exit of the borehole at the surface, wherein the method comprises:

measuring a plurality of drilling parameters, computing a first signal of a first indicator versus time, wherein the first indicator is obtained based on a first set of measured drilling parameters, and wherein the first indicator is representative of a first type of events happening at the bottom of the borehole, computing a second signal of a second indicator versus time, wherein the second indicator is obtained based on a second set of measured drilling parameters, and wherein the second indicator is representative of a second type of events happening at the exit of the borehole, wherein the second type of events is linked to the first type of events, characterizing a correlation between the first and second signals and determine at least a shift between the first and second signals, wherein characterizing the correlation comprises calculating, during a predetermined time window, a correlation coefficient between the first signal and a plurality of signals derived from the second signal, wherein each of the second derived signals correspond to the second signal with a respective predetermined shift, and determining at least one estimated transit time from the shift.

3. A method according to claim 2, wherein the element is one of the following:

a drilling fluid, cuttings carried by the drilling fluid, or gas carried by the drilling fluid.

4. A method according claim 2, wherein the plurality of drilling parameters are measured at the surface.

5. A method according to claim 2, wherein the first indicator is a flow rate of a pump injecting a drilling fluid in the borehole, a depth of the drill bit or a rate of penetration and the second indicator is a content of total gas at the exit of the borehole or a volume of cuttings at the exit of the borehole.

6. The method of claim 2, wherein the correlation coefficient is a Pearson's coefficient having a value between negative 1, representing perfect anti-correlation, and positive 1, representing perfect correlation.

7. The method of claim 2, wherein:

characterizing the correlation further comprises computing an optimum shift at which a value of the correlation is highest, and wherein determining at least one transit time comprises determining the at least one transit time from the optimal shift.

8. A method for estimating a transit time of an element circulating in a borehole during drilling of the borehole, wherein the transit time is representative of a time period for the element to move from the bottom of the borehole to the exit of the borehole at the surface, wherein the method comprises:

measuring a plurality of drilling parameters, computing a first signal of a first indicator versus time, wherein the first indicator is obtained based on a first set of measured drilling parameters, and wherein the first indicator is representative of a first type of events happening at the bottom of the borehole, computing a second signal of a second indicator versus time, wherein the second indicator is obtained based on a second set of measured drilling parameters, and wherein the second indicator is representative of a second type of events happening at the exit of the borehole, wherein the second type of events is linked to the first type of events, characterizing a correlation between the first and second signals and determine at least a shift between the first and second signals, determining at least estimated transit time from the shift computing a theoretical transit time based on a model of the borehole comprising parameters relative to the architecture of the borehole, and when a difference between the theoretical transit time and the estimated transit time goes over a predetermined threshold, iteratively correcting at least one parameter of the model.

9. A method according to claim 8, wherein the element is one of the following:

a drilling fluid, cuttings carried by the drilling fluid, or gas carried by the drilling fluid.

10. A method according claim 8, wherein the plurality of drilling parameters are measured at the surface.

11. A method according to claim 8, wherein the first indicator is a flow rate of a pump injecting a drilling fluid in the borehole, a depth of the drill bit or a rate of penetration and the second indicator is a content of total gas at the exit of the borehole or a volume of cuttings at the exit of the borehole.

12. The method of claim 8, wherein the at least one parameter of the model is iteratively corrected until the difference is less than the threshold.

13. A system for estimating a transit time of an element circulating in a borehole during the drilling of the borehole, wherein the transit time is representative of a time period for the element to move from the bottom of the borehole to the exit of the borehole situated at the surface, wherein the system comprises:

at least a measurement system for measuring a plurality of drilling parameters, and one or more processors configured to:

computing a first signal of a first indicator versus time, wherein the first indicator is obtained based on a first set measured drilling parameters, and wherein the first indicator is representative of a first type of events happening at the bottom of the borehole computing a second signal of a second indicator versus time, wherein the second indicator is obtained based on a second set of measured drilling parameters, and wherein the second indicator is representative of a second type of events happening at the exit of the borehole, wherein the second type of events is linked to the first type of events, characterizing a correlation between the first and second signals and determine at least a shift between the first and second signals, wherein characterizing the correlation comprises calculating, during a predetermined time window, a correlation coefficient between the first signal and a plurality of signals derived from the second signal, wherein each of the second derived signals correspond to the second signal with a respective predetermined shift, and determining at least an estimated transit time from the shift.

14. The system of claim 13, wherein the one or more processors are further configured to:

compute a theoretical transit time based on a model of the borehole comprising parameters relative to the architecture of the borehole, and iteratively correcting at least one parameter of the model when a difference between the theoretical transit time and the estimated transit time goes over a predetermined threshold.

* * * * *